US010366568B2

(12) United States Patent
Milligan

(10) Patent No.: US 10,366,568 B2
(45) Date of Patent: Jul. 30, 2019

(54) LOTTERY GAME PROVIDING A CHANCE TO WIN A JACKPOT AT A REDUCED COST TO THE PLAYER, WITH AN INCREASED REVENUE TO THE OPERATOR AND TICKET RETAILER

(71) Applicant: Henry Milligan, Wilmington, DE (US)

(72) Inventor: Henry Milligan, Wilmington, DE (US)

( * ) Notice: Subject to any disclaimer, the term of this patent is extended or adjusted under 35 U.S.C. 154(b) by 70 days.

(21) Appl. No.: 15/527,937

(22) PCT Filed: Nov. 12, 2015

(86) PCT No.: PCT/US2015/060295
§ 371 (c)(1),
(2) Date: May 18, 2017

(87) PCT Pub. No.: WO2016/081266
PCT Pub. Date: May 26, 2016

(65) Prior Publication Data

US 2018/0286180 A1 Oct. 4, 2018

Related U.S. Application Data

(60) Provisional application No. 62/081,746, filed on Nov. 19, 2014.

(51) Int. Cl.
*G07F 17/32* (2006.01)

(52) U.S. Cl.
CPC ..... *G07F 17/3258* (2013.01); *G07F 17/32* (2013.01); *G07F 17/329* (2013.01)

(58) Field of Classification Search
None
See application file for complete search history.

(56) References Cited

U.S. PATENT DOCUMENTS

| | | | | |
|---|---|---|---|---|
| 7,798,896 | B2 * | 9/2010 | Katz | A63F 3/00157 463/20 |
| 7,815,502 | B2 * | 10/2010 | Hardy | G07C 15/005 463/16 |
| 8,651,935 | B2 * | 2/2014 | Caro | G07C 15/005 463/17 |
| 8,727,853 | B2 * | 5/2014 | Katz | G07F 17/32 463/16 |
| 2005/0227759 | A1 | 10/2005 | Dolezal | |
| 2012/0282995 | A1 | 11/2012 | Allen et al. | |
| 2012/0302329 | A1 | 11/2012 | Katz et al. | |
| 2013/0225255 | A1 | 8/2013 | Irwin, Jr. et al. | |
| 2014/0057692 | A1 | 2/2014 | Bennett, III et al. | |

OTHER PUBLICATIONS

International Search Report and Written Opinion, dated Jan. 12, 2016, in corresponding International Patent Application No. PCT/US15/60295.

* cited by examiner

*Primary Examiner* — Ronald Laneau
(74) *Attorney, Agent, or Firm* — Reed Smith LLP; Ryan P. Cox

(57) ABSTRACT

A new method of playing a lottery or other game of chance is described in which a Player who purchased a ticket for a first lottery may subsequently purchase a "Milligan," a chance to win a subset of prizes at a subsequent lottery but at a reduced cost. Similar to a mulligan in golf, the "Milligan" affords the Player a second opportunity to play. While giving the Player the benefit of an additional, discounted chance to a win, this new method of play also provides Lottery Operators additional revenue at a lower payout risk. Ticket Retailers benefit from the new method of play because it may incentivize players to return to Ticket Retailers to purchase the "Milligan." Another new method of playing a lottery or other game of chance is described in which a Player may purchase a ticket for a lottery for a chance to win a subset of prizes but at a reduced cost is also provided.

20 Claims, No Drawings

LOTTERY GAME PROVIDING A CHANCE TO WIN A JACKPOT AT A REDUCED COST TO THE PLAYER, WITH AN INCREASED REVENUE TO THE OPERATOR AND TICKET RETAILER

CROSS-REFERENCE TO RELATED APPLICATIONS

The present application is the United States national stage of International Application No. PCT/US15/60295, filed Nov. 12, 2015, which claims priority to U.S. Provisional Application No. 62/081,746, which was filed on Nov. 19, 2014, and both of which are herein incorporated by reference in their entirety.

TECHNICAL FIELD

The present invention generally relates to all games of chance, to include lotteries. More particularly, the present invention relates to a system and method for implementing a lottery game that provides a Player who purchased a ticket at a first lottery to subsequently purchase, at a reduced cost, a chance at a subset of prizes at a subsequent lottery. In addition, the present invention relates to another system and method for implementing a lottery game that provides a Player the opportunity to purchase, at a reduced cost, a chance at a subset of prizes at a lottery.

The Player benefits from an additional chance to win at a discounted price, the Lottery Operator benefits from enhanced revenue with at lower payout risk, and lottery Ticket Retailers benefit from having players incentivized to visit and return to their places of business.

BACKGROUND ART

In known wagering games, each individual Player places a wager on the outcome of an event such as a roll of dice, a selection of one or more randomly generated indicia such as cards or numbers, a horse or dog race, a Jai Alai game, a sporting event, fantasy sports or the like, and the wager is won or lost depending on the outcome of the event. Typically, Players are able to place their wagers on one or more of several possible outcomes of an event, such that the actual outcome creates both winners and losers among the group of Players of a particular game. Some wagering games are designed around a particular apparatus such that the Players must seek out a gaming table or machine in order to play. Other games can be played anywhere people are gathered and wagering is available. Regardless of the game being played or the venue in which it is presented for wagering, there is a need for a gaming method that will attract new Players to wagering games and hold the attention of existing Players so that such games remain attractive relative to the many new games and diversions constantly being developed.

An example of such a game of chance is fantasy sports gaming. Fantasy sports operators and/or retailers derive significant revenue from the sale of entries into fantasy sports games. In a fantasy sports game, Players wager on the statistical outcomes for a selected group of athletes or teams in a particular sporting event or set of sporting events. The Player may select a set of athletes and/or teams from an available list or the athletes and/or teams may be randomly assigned to the Player. The selection of athletes and/or teams may be subject to constraints; for example, a Player may only be able to select a combination of athletes and/or teams wherein the pre-set salaries for the athletes and/or teams do not, in total, exceed a salary cap. Alternately, a Player may only be able to select athletes and/or teams who have not been previously selected by other Players. This may be accomplished by using a draft scheme wherein Players select athletes and/or teams in a predetermined order.

A set number of points or other gaming currency may be assigned to specific statistical outcomes of the sporting event or set of sporting events. For example, a touchdown scored by an athlete in a football sporting event may be assigned six points, which are earned by the Player upon the selected athlete scoring a touchdown. Winning Players may be determined based on the total number of points or other gaming currency earned. The number of winning Players and payouts will depend on the gaming structure employed and may include a large payout or jackpot for a Player or subset of Players.

Many governments and/or gaming organizations sponsor wagering games known as lotteries. A typical lottery game involves Players selecting permutations or combinations of numbers, the exact format, quantity and ordinal value range of the numbers being dependent on the type of game. Each set of numbers entered in a lottery drawing is referred to as an "entry." The numbers may be selected individually by the Player, or many Lottery Operators offer an option where, upon request by the Player, a random number generator controlled by the Lottery Operator is used to select some or all of the numbers of the entry. In either case, or in a combination of the two methods, the entry is typically made through computer and/or the completion of a machine-readable form having check boxes filled in to indicate the selected numbers. The Lottery Operator or Ticket Retailer typically prints a lottery "ticket" or receipt which lists each of the numbers of an entry selected by, or picked for a Player. The lottery ticket also typically includes a drawing identifier indicating for which drawing the entries are entered.

This is then followed by a "draw," in which a combination or permutation of numbers is randomly selected by the Lottery Organization. Prizes are awarded based on the number of matches between a Player's selections and the drawn numbers. Examples are the well-publicized, multi-million-dollar-jackpot lotteries popular throughout the world.

Lotteries have proven to be powerful and lucrative revenue generating mechanisms. In the United States, a majority of states now conduct lotteries which may offer daily and/or weekly jackpots up to millions of dollars. These lotteries provide income to help fund state educational systems or provide capital for improvements to the state's infrastructure. Some states have partnered to form multi-state lotteries which typically provide even larger jackpots due to the increased number of participants in each lottery.

These government and/or gaming organizations may run the lotteries themselves or they may hire contractors and consultants to either run or help run the lotteries. For purposes of this invention, these organizations, contractors and consultants are referred to, collectively, as Lottery Operators.

Lottery tickets may be purchased from a Lottery Operator directly or, more commonly, through agents authorized by the Lottery Operator to sell tickets. Typically, these authorized agents are retailers who offer additional products and services not related to lotteries. Alternatively, these retailers operate websites that include advertising and/or offers. For purposes of this invention, these agents are referred to, collectively, as Ticket Retailers. Whatever method is used to sell lottery tickets, Ticket Retailers benefit from Players either patronizing their places of business or visiting their websites.

Lotteries have become an important source of income to governments as they provide revenue for education and other programs. As additional revenues are needed, perhaps due to a reduction in Player participation or the need for additional governmental revenue, ticket prices increase. This can then have an adverse impact on Player participation and a negative impact on revenue.

As governments have grown more dependent on lotteries, it is equally important to sustain Player interest. One approach to invigorating lottery sales is to expand game content beyond traditional combination/permutation games. The new games may help keep current Players, as well as draw in new Players.

The development of new games and diversions can be costly and time consuming, without any certain outcome of whether the game will be accepted by the gaming public. Thus, modifications to accepted games are desirable if they provide additional incentive to play already-established games. Existing methods of supplementing game play do not provide the multitude of benefits realized by this new method. These include: (1) giving Players an opportunity to purchase a chance to win a jackpot or large prize at a reduced cost; (2) increasing revenue for the Lottery Operators, at a reduced payout risk; and (3) increasing traffic to Ticket Retailers' places of business and/or websites. These benefits may likewise be enjoyed by operators and/or retailers of any game of chance.

SUMMARY OF INVENTION

The present invention provides a system and method by which Players who participated in a lottery may elect to purchase a "Milligan" for an opportunity to win at a subsequent lottery but at a reduced cost. Similar to a mulligan in golf, the "Milligan" affords the Player a second opportunity to play.

The present invention also provides a system and method by which Players may elect to purchase an entry which is an opportunity to win any jackpot or large prize drawing, at a reduced cost as compared to an entry with a chance to win all available prizes in the game of chance.

MODES FOR CARRYING OUT THE INVENTION

In some embodiments, a method of playing a game of chance comprises a Player obtaining an entry from a Ticket Retailer for a chance to win a first set of prizes at a game of chance and the Player using the entry at the same or different Ticket Retailer to obtain a chance to win a subsequent set of prizes at a subsequent game of chance. In some embodiments, the game of chance is a lottery. In some embodiments, the game of chance is a fantasy sports game. In some embodiments, the entry is recorded on a ticket. In some embodiments, the subsequent set of prizes is a subset of those available. In some embodiments the Player obtains the chance to win a subsequent set of prizes from the same Ticket Retailer. In some embodiments, the game of chance is a lottery. The entry to obtain a chance to win a set of prizes at a subsequent game of chance may be purchased at a reduced cost as compared to the entry for a chance to win a first set of prizes.

In some embodiments, a method of playing a game of chance comprises a Player obtaining an entry from a Ticket Retailer for a chance to win a jackpot or large prize drawing and a reduced subset or no subset of lesser prizes. In some embodiments, the entry is purchased at a reduced cost as compared to a chance to win any available prizes in the game of chance.

In some embodiments, a ticket may be used for playing a game of chance that contains sufficient information to allow a Lottery Operator to track information when the ticket is used to obtain a chance to win a subsequent set of prizes at a subsequent game of chance. In some embodiments, the information is encoded in a manner that can be read by an electronic device that is in communication with a database that can authorize the use of the ticket to obtain a chance to win a subsequent set of prizes at a subsequent game. In some embodiments, the computer readable manner is a barcode.

As an entry into the first lottery game, the Player may choose to purchase, at a reduced cost, an entry for an opportunity to win any jackpot or large prize drawing. Any type of game can be played, such as an instant win lottery or a lottery game that utilizes a drawing. As a concession for the purchase of the entry, the Player may be eligible to win only a reduced subset of lesser prizes or no subset of lesser prizes.

The option to purchase an entry may incentivize the Player to take whatever action is necessary to participate in the lottery. This action could be visiting a Ticket Retailer's place of business, visiting a Ticket Retailer's website, or using an electronic device, such as a mobile phone application, to obtain the entry. Whatever the action necessary, the Lottery Operator and/or Ticket Retailer uses this to offer the Player additional products, services or advertising.

The incentive to obtain the entry can be from a reduced price for the entry, or from any other offer or incentive that induces the Player to take the action necessary to obtain the entry. In some embodiments, the entry is offered at a reduced price from the original ticket, for example where the entry is offered at 75%, 50%, 25% off the regular price to play the subsequent lottery. In some embodiments, the entry can be offered for free. It is within the scope of this invention to offer any incentive to the Player to take an action to obtain the entry.

Before a Milligan can be purchased, the Player must purchase an entry to a first lottery game. Any type of game can be played, such as an instant win lottery or a lottery game that utilizes a drawing. After the first game has been played, the Player may then choose to purchase a Milligan to use in a subsequent game. A Lottery Operator may elect to limit the set of prizes available to the user of a Milligan.

In obtaining the Milligan, the Player may elect to play the same set of numbers in the subsequent game as were played in the original game. Alternately, if permitted by the Lottery Operator, the Player using a Milligan may select a new set of numbers or have the numbers randomly selected to play in the subsequent game, for example, by a computer pick.

In obtaining the Milligan in a lottery that includes a drawing, the Lottery Operator may permit the Player to select different numbers for the Milligan, or the Lottery Operator may require that the same numbers be played in the Milligan that were played in the first lottery game.

In obtaining the Milligan in a lottery that includes a playing in a series of drawings, the Lottery Operator may permit the Player to select up to the same number of Milligans for the equivalent number of subsequent drawings. For example, if a Player purchases a lottery ticket for the next five (5) lottery drawings, the Lottery Operator may permit the Player to obtain up to five (5) Milligans, one for each of the next five drawings.

The option to purchase a Milligan may incentivize the Player to take whatever action is necessary to participate in the subsequent game. This action could be returning to a Ticket Retailer's place of business, visiting a Ticket Retailer's website, or using an electronic device, such as a mobile phone or similar application, to obtain a Milligan. Whatever the action necessary, the Lottery Operator and/or Ticket Retailer uses this to offer the Player additional products, services or advertising.

The incentive to obtain a Milligan can be from a reduced price for the Milligan, or from any other offer or incentive that induces the Player to take the action necessary to obtain a Milligan. In some embodiments, the Milligan is offered at a reduced price from the original ticket, for example where the Milligan is offered at 75%, 50%, 25% off the regular price to play the subsequent lottery. In some embodiments, the Milligan can be offered for free. It is within the scope of this invention to offer any incentive to the Player to take an action to obtain a Milligan.

Depending on the Lottery Operator's desire, the Milligan can be made available from any Ticket Retailer. Alternatively, the Lottery Operator can require that the Milligan be obtained only from the same Ticket Retailer that sold the original lottery entry, or not. The Lottery Operator may also elect to offer different incentives depending on where the Player obtains the Milligan. In some embodiments, the Player may obtain the Milligan from any Ticket Retailer at 25% off the regular price or return to the Ticket Retailer where the original entry was purchased and obtain the Milligan at 50% off the regular price. In some embodiments, the Player may obtain the Milligan from any Ticket Retailer at 50% off the regular price or return to the Ticket Retailer where the original entry was purchased and obtain the Milligan for free. It is within the scope of this invention to offer different incentives that depend upon how and where the Milligan is obtained.

In selecting incentives to encourage a Player to return to a Ticket Retailer, the Lottery Operator may include affiliates within the incentive. In other words, the Player gets the same incentive by obtaining the Milligan from the specific Ticket Retailer's place of business (or website) or by obtaining it from an affiliate of the Ticket Retailer, for example from the same business chain but at a different location.

The prizes available to the holder of a Milligan can be the same as for a Player who purchases a regular ticket, or they can be different. The incentive to purchase a Milligan is, of course, the chance to win a prize at a reduced cost to play. In a lottery game involving a subsequent drawing, it is believed that the incentive to play comes more from the chance to win the larger prizes than from the lower tier payouts. Thus, it is within the scope of this invention for the Lottery Operator to offer the same prizes for the Milligan, or to offer a subset of prizes depending on the Lottery Operator's belief on what best incentivizes the Player to obtain a Milligan. By offering only a subset of prizes, the Lottery Operator benefits from a reduced payout risk, because certain prizes may not be available to the Player of a Milligan. In some embodiments, the Milligan can be used only for the grand prize. In some embodiments, the Milligan can be used to win one of the top two or three prizes. It is within the scope of this invention to offer all prizes, or any subset of prizes, to the Player of a Milligan.

In addition to a new method of play, it is a further object of the present invention to provide a ticket that contains sufficient information to allow the Lottery Operator to track information that is used in obtaining the Milligan. For example a paper or similar "hard" ticket may contain a Universal Product Code ("UPC"), sometimes referred to as a barcode, that is specific to that ticket. A hard ticket can include a paper printout, or a ticket that is stored on a mobile device, or its equivalent. In some embodiments, the Player seeking to obtain a Milligan provides the ticket to the Ticket Retailer who then scans the UPC from the paper ticket, mobile device or the equivalent. The scanning system passes the barcode information to a computer system which accesses a database and returns information to the Ticket Retailer regarding pricing, and whether the Milligan can be obtained.

Any UPC format can be used, such as UPC-A, UPC-B, UPC-C, UPC-D, UPC-2, UPC-5, EAN as well as other formats and variations known in the industry, provided the format or variation is sufficient to contain the information necessary for the Lottery Operator to validate and/or price the Milligan.

It is also within the scope of this invention for the Player to scan the UPC using a mobile application ("app") on a smartphone, tablet, computer or similar device. The app can be provided, for example, by the Ticket Retailer or by the Lottery Operator. In some embodiments, the Player registers with the Lottery Operator or Ticket Retailer, and then downloads a app which contains its own UPC reader. When the Player wishes to obtain a Milligan, the UPC is scanned using the app. The app communicates with the Lottery Operator or Ticket Retailer for validation and pricing. If a Milligan is available and the Lottery Operator has elected to charge a fee for the Milligan, the Player is asked to confirm a deduction from an account previously established by the Player. Such systems can be used by the Lottery Operator or Ticket Retailer to send advertisements or other information to the Player's mobile device.

It is also within the scope of this invention to provide an entirely paperless process, for example, in which all transactions occur through a website. The features of such a paperless system may include playing a first lottery game, the Player's subsequent election to obtain a Milligan, and the requirement that the Player take some subsequent action to obtain the Milligan, such as revisiting a website. This subsequent action could then be exploited by the Lottery Operator or Ticket Retailer to provide additional products or services. The paperless process could also be employed for the purchase of an entry to win a jackpot or large prize and a subset or no subset of lesser prizes.

What is claimed is:

1. A method of playing a game of chance comprising:

providing a Player an entry recorded on a printed ticket to said game of chance from a Ticket Retailer, said game of chance comprising a prize structure, said prize structure comprising a jackpot and a plurality of lesser prizes, wherein said entry provides a chance to win said jackpot and a reduced subset or no subset of said plurality of lesser prizes, wherein said entry is printed on said ticket by a computer system configured to generate the entry based on random generation of the entry or user input and to print the entry on the printed ticket, and wherein the entry is purchased at a reduced cost as compared to an entry with a chance to win all available prizes in the game of chance.

2. The method of claim 1, wherein the game of chance is a lottery.

3. The method of claim 1, wherein said chance to win is a chance to win said jackpot and no subset of said plurality of lesser prizes.

4. The method of claim 1, wherein said reduced cost is chosen from 25%, 50% and 75% of the cost of an entry with a chance to win all available prizes in the game of chance.

5. The method of claim 4, wherein the game of chance is a lottery.

6. The method of claim 1, wherein said reduced cost is 75% of the cost of an entry with a chance to win all available prizes in the game of chance.

7. The method of claim 6, wherein the game of chance is a lottery.

8. The method of claim 7, wherein said chance to win is a chance to win said jackpot and no subset of said plurality of lesser prizes.

9. The method of claim 1, wherein said entry comprises a set of numbers, and wherein the computer system generates the set of numbers based on a random number generator or a machine-readable form comprising a selected set of numbers.

10. The method of claim 1, further comprising providing a barcode on said printed ticket, wherein the computer system is further configured to generate said barcode corresponding to said entry and to print said barcode on said printed ticket.

11. A method of playing a game of chance comprising:

providing a Player a first entry recorded on a first printed ticket to a first game of chance from a Ticket Retailer, said first game of chance comprising a prize structure, said prize structure comprising a jackpot and a plurality of lesser prizes, wherein said first entry provides a chance to win said jackpot and any of said plurality of lesser prizes; and providing the Player a second entry recorded on a second printed ticket to a second game of chance using the first entry from the same or different Ticket Retailer, said second game of chance comprising said prize structure, wherein said second entry provides a chance to win said jackpot and a reduced subset or no subset of said plurality of lesser prizes, wherein said first entry is printed on said first printed ticket by a computer system configured to generate the first entry based on random generation of the first entry or user input and to print the first entry on first printed ticket, wherein the second entry is printed on said second printed ticket by a computer system configured to generate the second entry based on random generation of the second entry or user input and to print the second entry on the second printed ticket, and wherein the second entry is purchased at a reduced cost as compared to the first entry.

12. The method of claim 11, wherein the second entry is provided from the same Ticket Retailer as the first entry.

13. The method of claim 11, wherein the game of chance is a lottery.

14. The method of claim 11, wherein the game of chance is a fantasy sports game.

15. The method of claim 11, wherein said second entry provides a chance to win said jackpot and no subset of said plurality of lesser prizes.

16. The method of claim 11, wherein said reduced cost is chosen from 25%, 50% and 75% of a cost of the first entry.

17. The method of claim 16, wherein the game of chance is a lottery.

18. The method of claim 11, wherein said reduced cost is 75% of a cost of the first entry.

19. The method of claim 18, wherein the game of chance is a lottery.

20. The method of claim 11, wherein the computer system configured to generate the first entry and the computer system configured to generate the second entry is the same computer system.

* * * * *